US011655079B1

(12) United States Patent
Huang

(10) Patent No.: US 11,655,079 B1
(45) Date of Patent: May 23, 2023

(54) ANTI-THEFT PLASTIC BOTTLE CAP

(71) Applicant: Chin-Tai Pharmaceutical Plastic Ltd., Hemei Township, Changhua County (TW)

(72) Inventor: Chun-Hung Huang, Hemei Township (TW)

(73) Assignee: Chin-Tai Pharmaceutical Plastic Ltd., Hemei Township (TW)

( * ) Notice: Subject to any disclaimer, the term of this patent is extended or adjusted under 35 U.S.C. 154(b) by 0 days.

(21) Appl. No.: 17/557,144

(22) Filed: Dec. 21, 2021

(51) Int. Cl.
*B65D 41/56* (2006.01)
*B65D 47/06* (2006.01)
*B65D 55/02* (2006.01)

(52) U.S. Cl.
CPC ..... *B65D 41/56* (2013.01); *B65D 47/06* (2013.01); *B65D 55/024* (2013.01); *B65D 2211/00* (2013.01); *B65D 2255/20* (2013.01)

(58) Field of Classification Search
CPC .... B65D 1/0238; B65D 1/0246; B65D 41/56; B65D 41/3409; B65D 34/3404; B65D 50/046; B65D 55/024; B65D 55/02; B65D 47/06
USPC ... 215/252, 253, 250, 316, 44, 43, 218, 219, 215/217
See application file for complete search history.

(56) References Cited

U.S. PATENT DOCUMENTS 2,135,330 A * 11/1938 Michaels ..... B65D 23/06 222/572
4,471,878 A * 9/1984 Davis ..... B65D 41/0421 215/258
4,664,278 A * 5/1987 Barriac ..... B65D 41/3433 215/252
4,993,570 A * 2/1991 Julian ..... B65D 41/3495 215/901
5,131,550 A * 7/1992 Thompson ..... B65D 41/3447 215/252
5,927,527 A * 7/1999 Montgomery ..... B65D 50/046 D9/453
D836,441 S * 12/2018 Huang ..... A61J 1/00 D9/453
2011/0114593 A1* 5/2011 Ishii ..... B65D 55/16 215/253

FOREIGN PATENT DOCUMENTS

GB 2232408 A * 12/1990 ..... B65D 41/3409
TW D190486 5/2018

* cited by examiner

*Primary Examiner* — Robert J Hicks
(74) *Attorney, Agent, or Firm* — Karin L. Williams; Alan D. Kamrath; Mayer & Williams PC

(57) ABSTRACT

An anti-theft plastic bottle cap contains a body and an anti-theft ring. The body is connected on an opening of a bottle. The anti-theft ring is mounted on a bottom of the body, and multiple equidistant connection teeth are formed between the body and the anti-theft ring. The body includes a first protrusion extending to the anti-theft ring from a bottom of the body, and the anti-theft ring includes two second protrusions extending to the body. The first protrusion is engaged with the two second protrusions when the body is rotated clockwise, such that the anti-theft plastic bottle cap is not rotated overly by using the first protrusion and the two second protrusions to avoid a removal of the anti-theft ring from the body and the anti-theft ring before a user detaches the anti-theft plastic bottle cap from the bottle.

3 Claims, 5 Drawing Sheets

ANTI-THEFT PLASTIC BOTTLE CAP

FIELD OF THE INVENTION

The present invention related to a plastic bottle cap, and more particularly to an anti-theft plastic bottle cap.

BACKGROUND OF THE INVENTION

Because of advanced medicine, a variety of drugs are used very frequently. In addition to the efficacy of the drug itself, the shape of the drug can be divided into liquid, granular, powder, etc., and various drugs must have a compatible bottle to ensure the tightness of the drug and not affect original chemistry of the various drugs.

There is a liquid medicine bottle that can hold liquid medicine, which is suitable for eye drops and other external liquid medicine. The liquid medicine bottle includes a bottle cap and a body for accommodating the liquid medicine, and the bottle cap is used to close the body. The body has an outlet for the liquid medicine to flow out, so the user can use the liquid medicine from the outlet as long as the lid of the bottle is opened.

Referring to FIG. 1, a bottle cap is disclosed in TW Design No. D190486 and contains a fitting ring 71, a threaded section extending from the fitting ring 71 and engaged with multiple anti-theft teeth 72 of an anti-theft ring 73 of a top of a medicine bottle, such that the multiple anti-theft teeth 72 are removed after rotating the bottle cap.

However, when the bottle cap is overly rotated, the multiple anti-theft teeth are inadvertently removed.

The present invention has arisen to mitigate and/or obviate the afore-described disadvantages.

SUMMARY OF THE INVENTION

The primary aspect of the present invention is to provide an anti-theft plastic bottle cap by which when the anti-theft plastic bottle cap is connected on the bottle by way of a packing machine, the first protrusion is engaged with the two second protrusions to avoid the anti-theft plastic bottle cap from being overly rotated, thus preventing the removal of the multiple equidistant connection teeth from the body and the anti-theft ring before the user detaches the anti-theft plastic bottle cap from the bottle.

To obtain above-mentioned aspect, an anti-theft plastic bottle cap provided by the present invention contains: a body and an anti-theft ring.

The body is connected on an opening of a bottle.

The anti-theft ring is mounted on a bottom of the body, and multiple equidistant connection teeth are formed between the body and the anti-theft ring, such that after the body is rotated counterclockwise to remove from the multiple equidistant connection teeth, a user learns the bottle is opened or is not opened by distinguishing whether the body is removed from the multiple equidistant connection teeth or not.

The body includes a first protrusion extending to the anti-theft ring from a bottom of the body, and the anti-theft ring includes two second protrusions extending to the body. The first protrusion is engaged with the two second protrusions when the body is rotated clockwise, such that the anti-theft plastic bottle cap is not rotated overly by using the first protrusion and the two second protrusions to avoid a removal of the anti-theft ring from the body and the anti-theft ring before the user detaches the anti-theft plastic bottle cap from the bottle.

Preferably, when the anti-theft plastic bottle cap is connected on the bottle by way of a packing machine, the first protrusion is engaged with the two second protrusions to avoid the anti-theft plastic bottle cap is rotated overly, thus preventing the removal of the multiple equidistant connection teeth from the body and the anti-theft ring before the user detaches the anti-theft plastic bottle cap from the bottle.

DETAILED DESCRIPTION OF THE PREFERRED EMBODIMENTS

With reference to FIGS. 2 to 5, an anti-theft plastic bottle cap according to a preferred embodiment of the present invention is capable of avoiding a removal before a user detaches the anti-theft plastic bottle cap, and the anti-theft plastic bottle cap is applicable for a variety of bottles (such as eye drop bottles or medicine bottles) made of plastic. In this embodiment, the anti-theft plastic bottle cap is applicable for an eye drop bottle. However, in another embodiment, the anti-theft plastic bottle cap is applicable for a medicine bottle.

Figure 1:
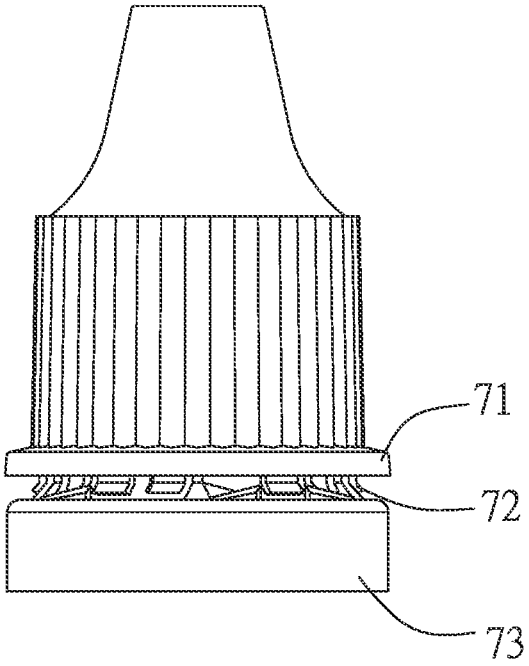
PRIOR ART FIG.1
FIG. 1 is a perspective view of a conventional bottle cap.
Figure 2:
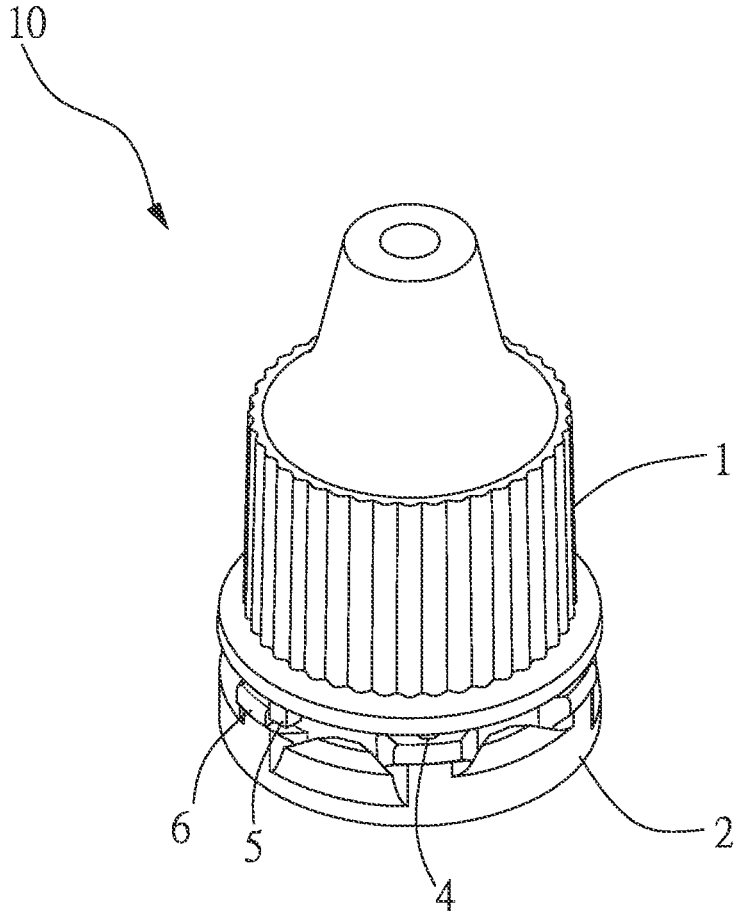
FIG. 2 is a perspective view showing the assembly of the anti-theft plastic bottle cap according to a preferred embodiment of the present invention.
Figure 5:
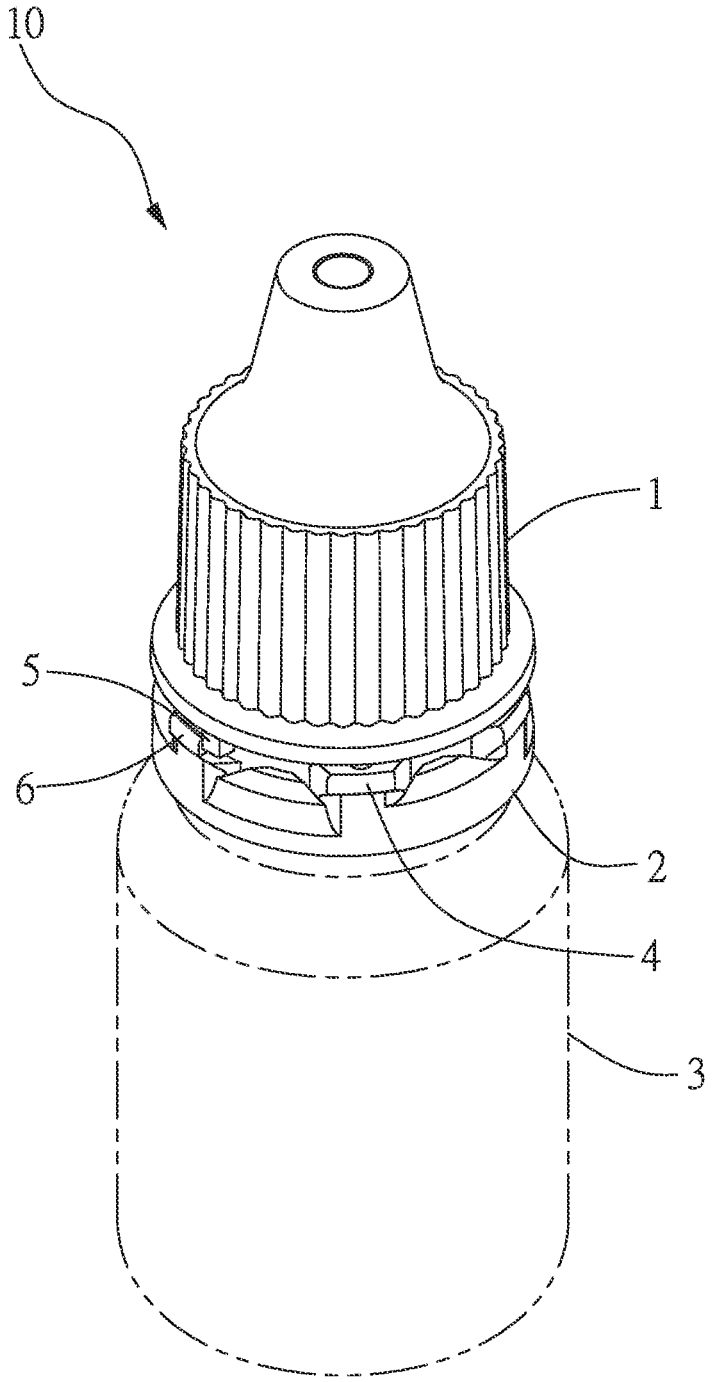
FIG. 5 is a perspective view showing the application of the anti-theft plastic bottle cap according to the preferred embodiment of the present invention.

Referring to FIG. 5, the anti-theft plastic bottle cap 10 comprises a body 1 and an anti-theft ring 2, wherein the body 1 is connected on an opening of a bottle 3. As shown in FIG. 2, the anti-theft ring 2 is mounted on a bottom of the body 1, and multiple equidistant connection teeth 4 are formed between the body 1 and the anti-theft ring 2, such that after the body 1 is rotated counterclockwise to remove from the multiple equidistant connection teeth 4, the user learns the bottle 3 is opened or is not opened by distinguishing whether the body 1 is removed from the multiple equidistant connection teeth 4 or not.

Figure 3:
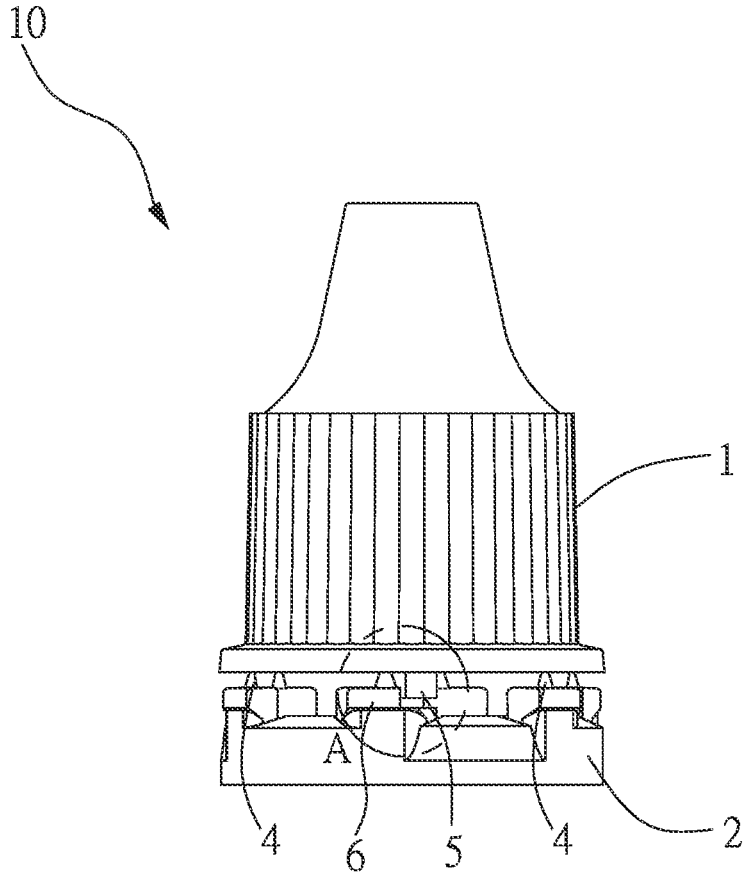
FIG. 3 is another perspective view showing the assembly of the anti-theft plastic bottle cap according to the preferred embodiment of the present invention.
Figure 4:
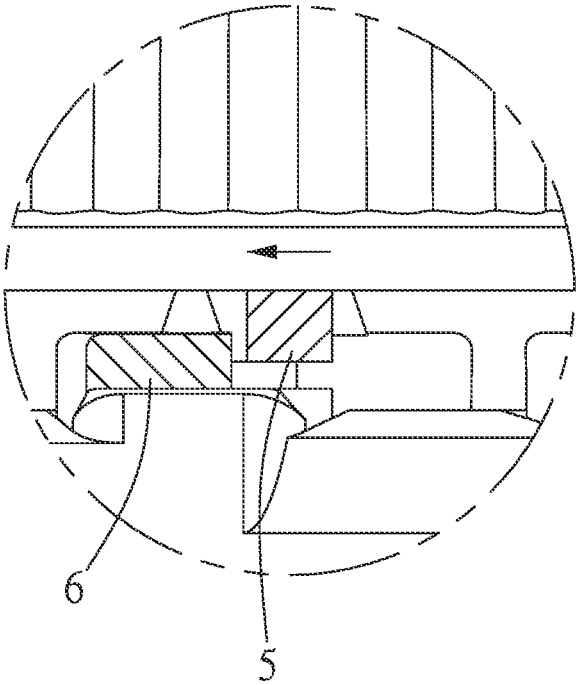
FIG. 4 is an amplified cross-sectional view showing the assembly of a portion A of FIG. 3.

As illustrated in FIGS. 3 and 4, the body 1 includes a first protrusion 5 extending to the anti-theft ring 2 from a bottom of the body 1, and the anti-theft ring 2 includes two second protrusions 6 extending to the body 1, wherein the first protrusion 5 is engaged with the two second protrusions 6 when the body 1 is rotated clockwise, such that the anti-theft plastic bottle cap 10 is not rotated overly by using the first protrusion 5 and the two second protrusions 6 to avoid a removal of the anti-theft ring 2 from the body 1 and the anti-theft ring 2 before the user detaches the anti-theft plastic bottle cap from the bottle.

Preferably, when the anti-theft plastic bottle cap 10 is connected on the bottle 3 by way of a packing machine (not shown), the first protrusion 5 is engaged with the two second protrusions 6 to avoid the anti-theft plastic bottle cap 10 is rotated overly, thus preventing the removal of the multiple equidistant connection teeth 4 from the body 1 and the anti-theft ring 2 before the user detaches the anti-theft plastic bottle cap 10 from the bottle 3.

While the preferred embodiments of the invention have been set forth for purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. An anti-theft plastic bottle cap comprising;

a body configured to be connected on an opening of a bottle;

an anti-theft ring mounted on a bottom of the body; and multiple equidistant connection teeth between the body and the anti-theft ring, wherein the body includes a first protrusion extending to the anti-theft ring from the bottom of the body, and the anti-theft ring includes two second protrusions extending to the body, wherein the multiple equidistant connection teeth each extend from a top surface of the two second protrusions, wherein when the body is rotated counterclockwise, the multiple equidistant connection teeth are removed, allowing a user to determine that the bottle has been opened, and, wherein when the body is rotated clockwise, the first protrusion engages with the two second protrusions, such that the anti-theft plastic bottle cap is not rotated overly by using the first protrusion and the two second protrusions to avoid a removal of the anti-theft ring from the body and the anti-theft ring before the user detaches the anti-theft plastic bottle cap from the bottle.

2. The anti-theft plastic bottle cap as claimed in claim 1, wherein the anti-theft plastic bottle cap is connected on an eye drop bottle.

3. The anti-theft plastic bottle cap as claimed in claim 1, wherein the anti-theft plastic bottle cap is connected on a medicine bottle.

* * * * *